US006450147B2

(12) United States Patent
Demura et al.

(10) Patent No.: US 6,450,147 B2
(45) Date of Patent: Sep. 17, 2002

(54) FUEL PRESSURE CONTROL APPARATUS OF INTERNAL COMBUSTION ENGINE

(75) Inventors: Takayuki Demura, Mishima (JP); Hiroyuki Mizuno, Toyota (JP); Koichi Yonezawa, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 35 days.

(21) Appl. No.: 09/814,872

(22) Filed: Mar. 23, 2001

(30) Foreign Application Priority Data

Mar. 23, 2000 (JP) ..... 2000-082312

(51) Int. Cl.[7] ..... F02M 37/06; F02M 69/16

(52) U.S. Cl. ..... 123/458

(58) Field of Search ..... 123/457, 458, 123/497, 506, 511, 512

(56) References Cited

U.S. PATENT DOCUMENTS 5,505,180 A * 4/1996 Otterman et al. ..... 123/497
5,775,304 A * 7/1998 Kono et al. ..... 123/497
6,357,422 B1 * 3/2002 Doane et al. ..... 123/458

FOREIGN PATENT DOCUMENTS

JP A 6-137199 5/1994
JP 2000-205018 * 7/2000

* cited by examiner

*Primary Examiner*—Tony M. Argenbright
(74) *Attorney, Agent, or Firm*—Kenyon & Kenyon

(57) ABSTRACT

A fuel pressure control apparatus and method controls a pressure of fuel that is delivered from a fuel pump to a fuel pipe in an internal combustion engine of a vehicle. A controller of the fuel pressure control apparatus calculates a controlled variable based on at least an integral term that is updated in accordance with a difference between an actual fuel pressure in the fuel pipe and a target value thereof; and controls an amount of the fuel delivered from the fuel pump in a feedback manner, using the controlled variable, so that the actual fuel pressure approaches the target value. During the control of the fuel pressure, the controller inhibits updating of the integral term to a value that results in an increase in the amount of the fuel delivered from the fuel pump, when the amount of the fuel delivered is approximate to or equal to a maximum value thereof.

14 Claims, 6 Drawing Sheets

FUEL PRESSURE CONTROL APPARATUS OF INTERNAL COMBUSTION ENGINE

INCORPORATION BY REFERENCE

The disclosure of Japanese Patent Application No. 2000-082312 filed on Mar. 23, 2000, including the specification, drawings and abstract, is incorporated herein by reference in its entirety.

BACKGROUND OF THE INVENTION

1. Field of the Invention

The invention relates to a fuel pressure control apparatus of an internal combustion engine.

2. Description of Related Art

Generally, in an internal combustion engine of the type in which fuel is directly injected into a combustion chamber, the fuel supplied to a fuel injection valve or valves is pressurized by a high-pressure fuel pump, so that the fuel pressure is increased to a value (target value) that permits fuel injection against the pressure in the combustion chamber. The fuel pressure is thus controlled by driving the high-pressure fuel pump in a controlled manner based on a controlled variable that is calculated based on the actual fuel pressure in a fuel pipe and a target value thereof, and by controlling the amount of fuel delivered from the pump in a feedback fashion so that the actual fuel pressure approaches the target value.

The aforementioned controlled variable used in the control in driving the high-pressure fuel pump is calculated based on an integral term that is updated in accordance with a difference between an actual fuel pressure and a target value thereof, a proportional term that is increased or decreased so as to make the difference between the actual fuel pressure and the target value equal to "0". If this controlled variable increases, the amount of fuel delivered from the high-pressure fuel pump increases, resulting in an increase, in the fuel pressure. Conversely, if the controlled variable decreases, the amount of fuel delivered from the high-pressure fuel pump decreases, resulting in a decrease in the fuel pressure.

If the actual fuel pressure becomes excessively higher than the target value, both the integral term and the proportional term are reduced so as to reduce the actual fuel pressure down to the target value. However, since it takes substantial time to reduce the fuel pressure, the integral term becomes excessively small before the actual fuel pressure is reduced down to the target pressure. If the integral term becomes excessively small, the actual fuel pressure cannot be kept at the target value after being reduced to the target value. As a result, the fuel pressure is further reduced, thereby causing so-called "undershoot".

In view of the above problem, it has been proposed to inhibit updating of the integral term if the actual fuel pressure becomes excessively higher than a target value, as in a fuel pressure control apparatus as disclosed in, for example, Japanese laid-open Patent Publication No. 6-137199. In this case, the integral term is prevented from becoming excessively small when the actual fuel pressure is reduced to the target value, and thus the undershoot as mentioned above can be prevented.

When the fuel pressure is at a low level even though the required amount of fuel injection is large, for example, at the time of a start of the internal combustion engine, the amount of fuel delivered from the high-pressure fuel pump is set to a value close to or equal to the maximum value so as to promptly raise the fuel pressure to the target value. In this case, even if the integral term is increased so as to raise the fuel pressure, the amount of fuel delivered does not further increase, and therefore the fuel pressure does not rise rapidly. In that case, the integral term tends to be an excessively large value.

Although the integral term starts decreasing after the actual fuel pressure exceeds the target value, the integral term decreases at a low rate or speed. Therefore, the controlled variable used for controlling the amount of fuel delivered from the high-pressure fuel pump, which is obtained after the actual fuel pressure reaches the target value, deviates from the required value in such a direction as to increase the amount of fuel delivered, because of the excessively increased integral term. As a result, the actual fuel pressure exceeds the target value to an excessively large extent, namely, so-called "overshoot" occurs, resulting in a problem such as deterioration of the combustion state of the internal combustion engine.

SUMMARY OF THE INVENTION

It is therefore an object of the invention to provide a fuel pressure control apparatus of an internal combustion engine, which is capable of substantially preventing the actual fuel pressure from excessively increasing above a target value due to an excessive increase in the integral term during the time in which the amount of fuel delivered from a fuel pump is approximate to or equal to the maximum value.

To accomplish the above and/or other objects, the invention provides a fuel pressure control apparatus for controlling a pressure of, a fuel that is delivered from a fuel pump to a fuel pipe in an internal combustion engine of a vehicle. A controller of the fuel pressure control apparatus calculates a controlled variable based on at least an integral term that is updated in accordance with a difference between an actual fuel pressure in the fuel pipe and a target value thereof, and controls an amount of the fuel delivered from the fuel pump in a feedback manner, using the controlled variable, so that the actual fuel pressure approaches the target value. The controller inhibits updating of the integral term to a value that results in an increase in the amount of the fuel delivered from the fuel pump, when the amount of the fuel delivered is approximate to or equal to a maximum value thereof.

When the amount of fuel delivered from the fuel pump is approximate to or equal to the maximum value, for example, at the time of a start of the engine, the fuel pressure is not rapidly increased even if the integral term is updated so as to increase the fuel pressure to the target value. Accordingly, the integral term may be undesirably changed (i.e., increased) to an excessively large value that causes an increase in the amount of fuel delivered. With the above arrangement of the invention, however, the upgrading of the integral term in a direction as to increase the amount of fuel delivered is inhibited when the amount of fuel delivered from the fuel pump is close to or equal to the maximum value, and therefore the integral term is prevented from being excessively changed or increased to an excessively large value that causes an increase in the amount of fuel delivered. It is thus possible to suppress or avoid so-called "overshoot" that would otherwise occur when the actual fuel pressure increases to a great extent above the target value due to the excessively increased integral term that had been updated while the amount of fuel delivered from the fuel pump was close to or equal to the maximum value.

In one preferred embodiment of the invention, the updating of the integral term to a value that results in an increase in the amount of the fuel delivered from the fuel pump is inhibited at least when the amount of the fuel delivered becomes approximate to or equal to the maximum value while the actual fuel pressure is increasing toward the target value.

While the actual pressure of the fuel supplied to fuel injection valves is increasing toward the target value in the conventional apparatus, the integral term is in the course of being gradually upgraded to values that will increase the amount of fuel delivered from the fuel pump. With the arrangement of the above preferred embodiment, when the amount of the fuel delivered from the fuel pump almost reaches the maximum value, the integral term is inhibited from being updated to values that will increase the amount of fuel delivered. Thus, the integral term is appropriately prevented from changing to an excessively large extent thereby to undesirably increase the amount of the fuel delivered when the actual fuel pressure reaches and exceeds the target value.

In another preferred embodiment of the invention, the integral term is reset to a value that results in a decrease in the amount of the fuel delivered from the fuel pump, when the updating of the integral term starts being inhibited.

With the above arrangement, the integral term is not only inhibited from being updated to larger values that will increase the amount of fuel delivered from the fuel pump when the amount of delivered fuel almost reaches the maximum value, but also is positively updated or reset to a smaller value that will reduce the amount of fuel delivered. It is therefore possible to further appropriately prevent the integral term from excessively changing in a direction as to increase the amount of fuel delivered.

BRIEF DESCRIPTION OF THE DRAWINGS

The foregoing and further objects, features and advantages of the invention will become apparent from the following description of a preferred embodiment with reference to the accompanying drawings, wherein like numerals are used to represent like elements and wherein.

DETAILED DESCRIPTION OF PREFERRED EMBODIMENT

A preferred embodiment of the invention when it is applied to an automotive engine will be described hereinafter with reference to FIGS. 1 to 6.

Figure 2:
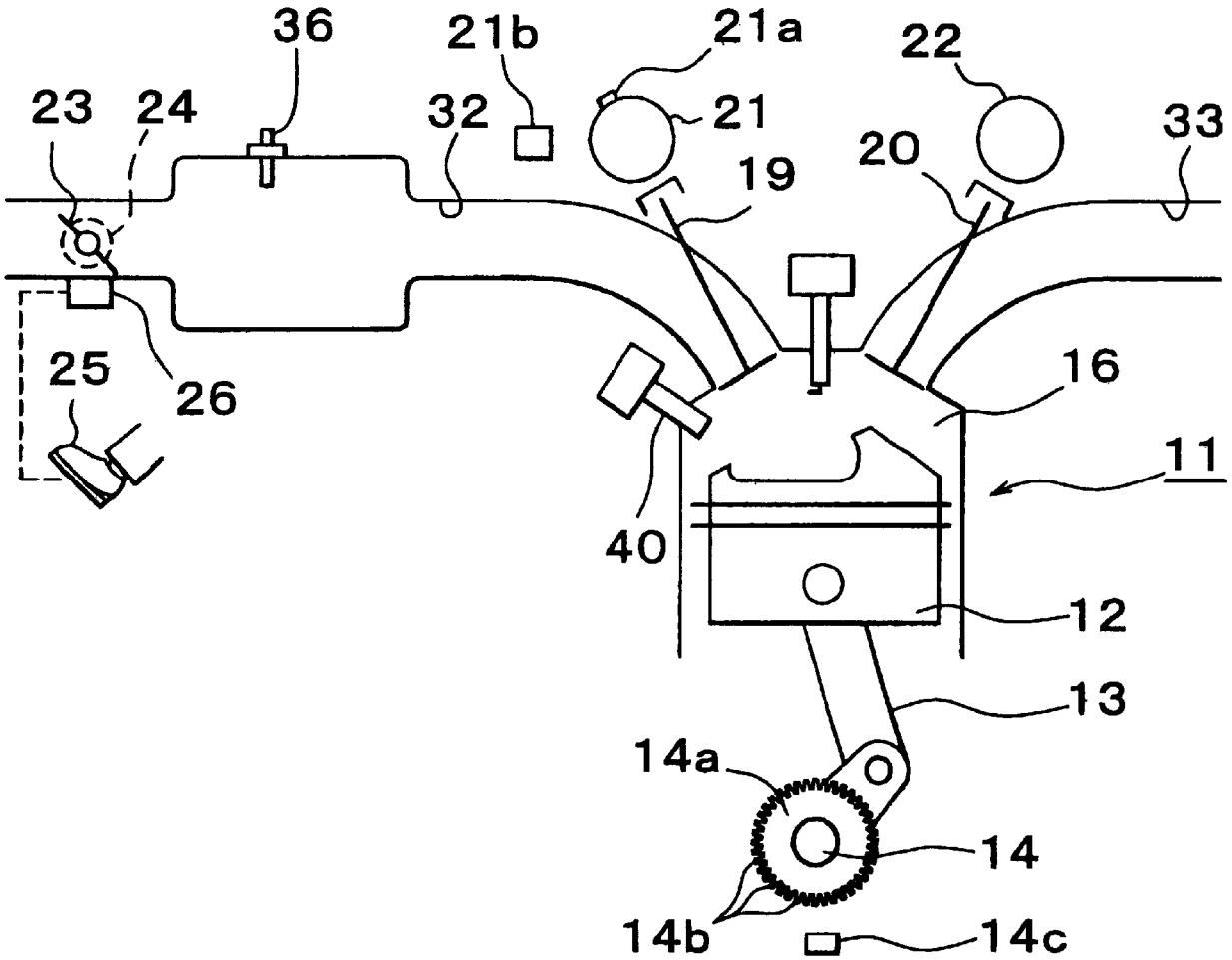
FIG. 2 is a schematic diagram illustrating the internal combustion-engine.

Referring first to FIG. 2, an engine 11 has a piston 12 that is connected to a crankshaft 14 via a connecting rod 13. Reciprocating movements of the piston 12 are converted into rotary motion of the crankshaft 14 by the connecting rod 13. A signal rotor 14*a* having a plurality of protrusions 14*b* is attached to the crankshaft 14. A crank position sensor 14*c* is provided at one side of the signal rotor 14*a*. The sensor 14*c* is adapted to output a signal in the form of pulses corresponding to respective protrusions 14*b* during rotation of the crankshaft 14.

An intake passage 32 and an exhaust passage 33 are connected to a combustion chamber 16 of the engine 11. The intake passage 32 and the combustion chamber 16 are brought into communication with each other or are disconnected or shut off from each other by opening or closing an intake valve 19, while the exhaust passage 33 and the combustion chamber 16 are brought into communication with each other or are disconnected from each other by opening or closing an exhaust valve 20. The intake valve 19 and the exhaust valve 20 are opened and closed by rotation of an intake camshaft 21 and an exhaust camshaft 22, respectively, to which rotary motion of the crankshaft 14 is transmitted. A cam position sensor 21*b* is provided at one side of the intake camshaft 21 having a protrusion 21*a* formed thereon. The cam position sensor 21*b* is adapted to output a detection signal each time the protrusion 21*a* passes the cam position sensor 21*b* during rotation of the camshaft 21.

A throttle valve 23 for adjusting the amount of air introduced into the engine 11 is provided in an upstream portion of the intake passage 32. The opening of the throttle valve 23 is adjusted by a throttle motor 24 in accordance with the operating amount (i.e., the amount of depression) of an accelerator pedal 25 provided in a compartment of the automobile. The amount of depression of the accelerator pedal 25 (i.e., the accelerator operating amount) is detected by an accelerator position sensor 26. A vacuum sensor 36 for detecting the pressure in the intake passage 32 (i.e., the intake air pressure) is provided in a portion of the intake passage 32 downstream of the throttle valve 23.

The engine 11 has a fuel injection valve 40 that directly injects fuel into the combustion chamber 16 to form a mixture of fuel and air. By utilizing combustion of the air-fuel mixture in the combustion chamber 16, the piston 12 is reciprocated to rotate the crankshaft 14, thereby to drive the engine 11.

The construction of a fuel system of the engine 11 for supplying high-pressure fuel to fuel injection valves 40 will be described with reference to FIG. 1.

Figure 1:
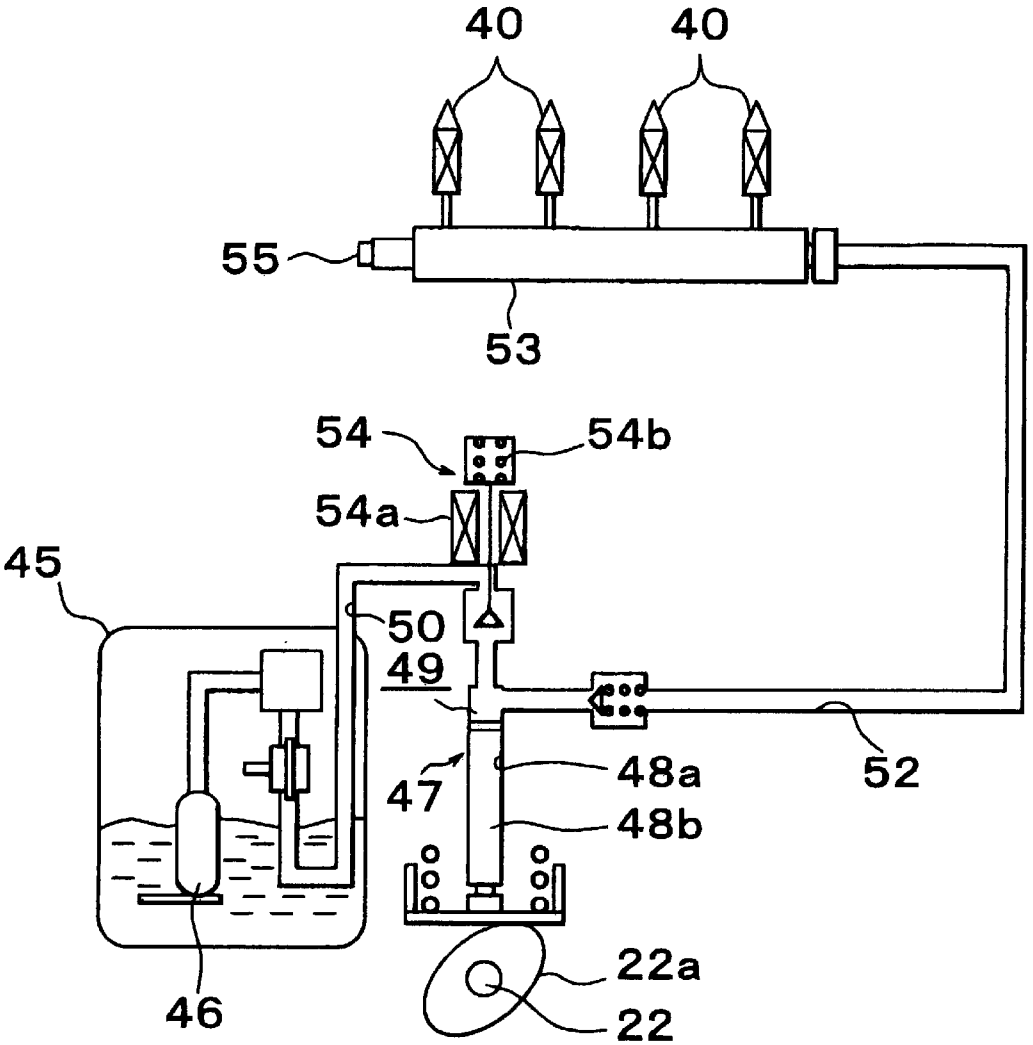
FIG. 1 is a schematic diagram illustrating a fuel system of an engine in which a fuel pressure control apparatus of a preferred embodiment of the invention is employed.

As shown in FIG. 1, the fuel system of the engine 11 has a feed pump 46 for pumping fuel out of a fuel tank 45, and a high-pressure fuel pump 47 for pressurizing fuel that is fed from the feed pump 46 and delivering the pressurized fuel toward the fuel injection valves 40.

The high-pressure fuel pump 47 has a cylinder, 48*a*, a plunger 48*b* that is received in the cylinder 48*a*, and a pressure chamber 49 that is defined by the cylinder 48*a* and the plunger 48*b*. In operation, the plunger 48*b* reciprocates within the cylinder 48*a* in accordance with rotation of a cam 22*a* mounted on the exhaust camshaft 22. The pressure chamber 49 is connected to the feed pump 46 via a low-pressure fuel passage 50, and is connected to a delivery pipe 53 via a high-pressure fuel passage 52. The fuel injection valves 40 are connected to the delivery pipe 53. The delivery pipe 53 is provided with a fuel pressure sensor 55 for detecting the fuel pressure in the delivery pipe 53.

The high-pressure fuel pump 47 is provided with an electromagnetic spill valve 54 for connecting and disconnecting the low-pressure fuel passage 50 to and from the pressure chamber 49. The electromagnetic spill valve 54 has an electromagnetic solenoid 54*a*. In operation, a voltage that is applied to the electromagnetic solenoid 54*a* is controlled so as to open and close the electromagnetic spill valve 54. Also, a coil spring 54*b* is provided at one end of the electromagnetic spill valve 54 that is remote from its valve head, for biasing the spill valve 54 in the opening direction.

When the electromagnetic solenoid 54*a* stops being energized, the electromagnetic spill valve 54 is opened under the bias force of the coil spring 54*b*, so that the low-pressure fuel passage 50 and the pressure chamber 49 communicate with each other. With the spill valve 54 being in this open position, fuel is fed from the feed pump 46 into the pressure chamber 49 via the low-pressure fuel passage 50 as the plunger 48*b* moves downward as viewed in FIG. 1 (during an intake stroke) so as to increase the volume of the pressure chamber 49.

When the plunger 48*b* moves upward as viewed in FIG. 1 (during a delivery stroke) so as to reduce the volume of the pressure chamber 49, the electromagnetic solenoid 54*a* is energized so as to close the electromagnetic spill valve 54 against the bias force of the coil spring 54*b*. As a result, the low-pressure fuel passage 50 and the pressure chamber 49 are disconnected from each other, and the fuel is ejected from the pressure chamber 49 into the high-pressure fuel passage 52 and the delivery pipe 53.

The amount of fuel delivered from the high-pressure fuel pump 47 is adjusted by controlling a point of time at which the electromagnetic spill valve 54 starts being closed, so as to adjust a duration in which the electromagnetic spill valve 54 is closed during the delivery stroke. The point of time at which the spill valve 54 starts being closed will be called "valve closing start timing", and the duration in which the spill valve 54 is closed will be called "valve closing duration". More specifically, the amount of fuel delivered increases as the closing duration of the electromagnetic spill valve 54 is increased by advancing the valve closing start timing. The amount of fuel delivered decreases as the closing duration of the electromagnetic spill valve 54 is reduced by retarding the valve closing start timing. By adjusting the amount of fuel delivered from the high-pressure fuel pump 47 in this manner, the fuel pressure in the delivery pipe 53 is controlled as desired.

Figure 3:
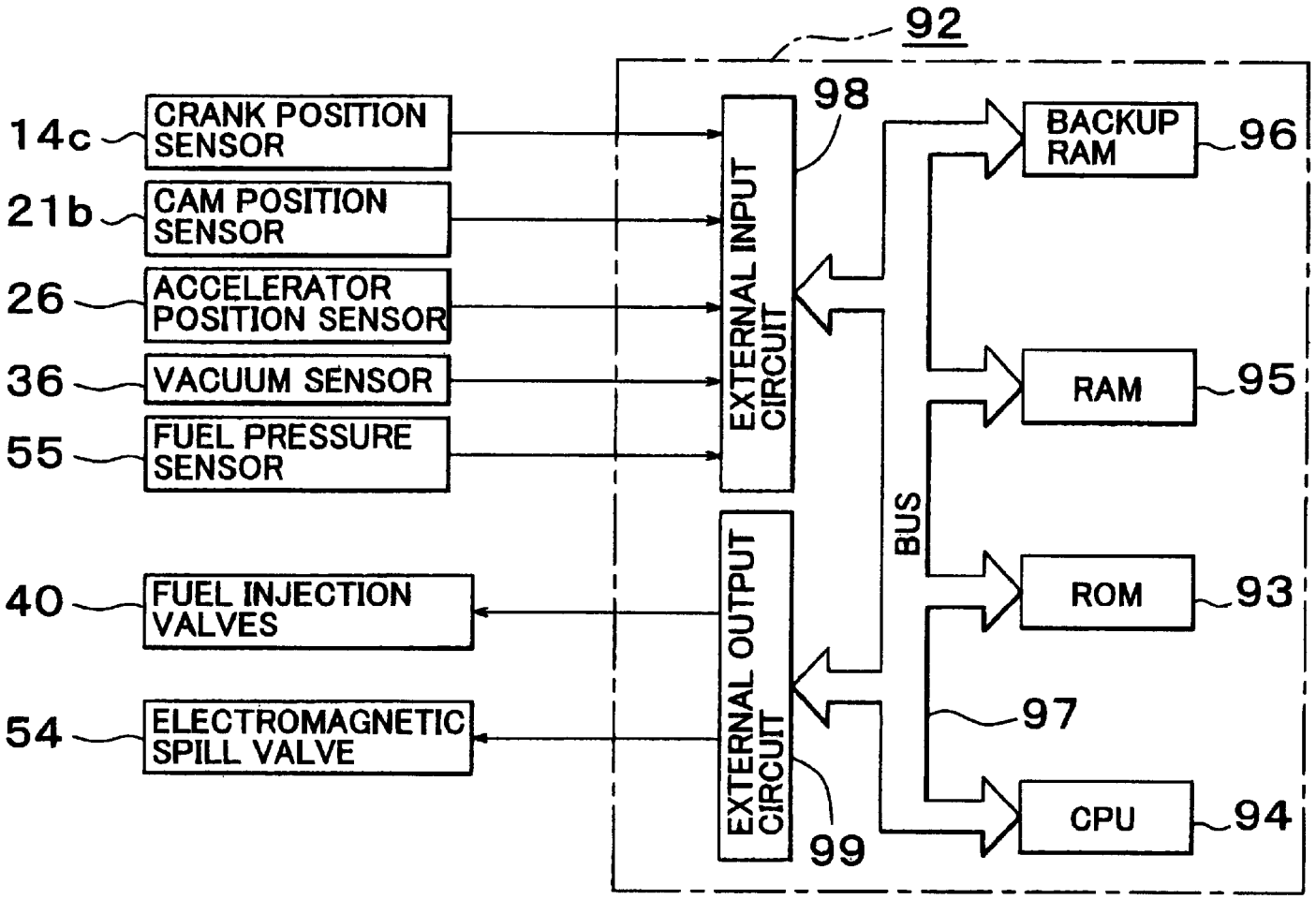
FIG. 3 is a block diagram illustrating an electrical arrangement of the fuel pressure control apparatus.

Next, an electrical arrangement of a fuel pressure control apparatus according to this embodiment will be described with reference to FIG. 3.

The fuel pressure control apparatus has an electronic control unit (hereinafter, referred to as "ECU") 92 for controlling, for example, the operating state of the engine 11. The ECU 92 is constructed as an arithmetic logic circuit having a ROM 93, a CPU 94, a RAM 95, a backup RAM 96, etc.

The ROM 93 is a memory storing various control programs, maps that are referred to during execution of the various control programs, etc. The CPU 94 executes processing operations based on the various control programs and maps stored in the ROM 93. The RAM 95 is a memory for temporarily storing results of operations executed by the CPU 94, data received from various sensors, etc. The backup RAM 96 is a non-volatile memory that stores data and the like that need to be retained during a stop of the engine 11. The ROM 93, the CPU 94, the RAM 95 and the backup RAM 96 are interconnected and are connected to an external input circuit 98 and an external output circuit 99, via a bus 97.

The external input circuit 98 is connected to the crank position sensor 14*c*, the cam position sensor 21*b*, the accelerator position sensor 26, the vacuum sensor 36, the fuel pressure sensor 55, and others. The external output circuit 99 is connected to the fuel injection valves 40, the electromagnetic spill valve 54, and others.

The ECU 92 constructed as described above calculates a final amount of fuel injection Qfin that is used to control the amount of fuel injected from the fuel injection valves 40, based on an engine speed NE, a load factor KL, etc. The engine speed NE is determined based on a detection signal from the crank position sensor 14*c*. The load factor KL is a value indicating the proportion of the present load with respect to the maximum engine load of the engine 11. The load factor KL is calculated from the engine speed NE and a parameter corresponding to the amount of intake air drawn into the engine 11. Examples of the parameter corresponding to the amount of intake air include an intake air pressure PM that is determined based on a detection signal from the vacuum sensor 36, and an amount of depression of the accelerator pedal ACCP that is determined based on a detection signal from the accelerator position sensor 26.

Based on the final fuel injection amount Qfin calculated as described above, the ECU 92 operates to drive the fuel injection valves 40 in a controlled manner, and controls the amount of fuel injected from the fuel Injection valves 40. The amount of fuel injected from the fuel injection valves 40 (i.e., the fuel injection amount) is determined by a fuel pressure P in the delivery pipe 53 and a duration in which the fuel is injected (which will be called "fuel injection duration"). In order to provide an appropriate fuel injection amount, therefore, it is necessary to keep the fuel pressure P at an appropriate level. Hence, the ECU 92 keeps the fuel pressure P obtained based on a detection signal from the fuel pressure sensor 55 at an appropriate level or value by feedback-controlling the amount of fuel delivered from the high-pressure fuel pump 47 so that the fuel pressure P approaches a target fuel pressure P0 that is set in accordance with the engine operation state. The amount of fuel fed from the high-pressure fuel pump 47 is controlled in a feedback fashion by adjusting the valve closing duration (valve closing start timing) of the electromagnetic spill valve 54 based on a duty ratio DT as described below.

The aforementioned duty ratio DT, which is a controlled variable used for controlling the amount of fuel ejected from the high-pressure fuel pump 47 (or the valve closing start timing of the electromagnetic spill valve 54), will be now described in detail. The duty ratio DT changes within the range of 0 to 100%, and is related to the cam angle of the cam 22*a* that corresponds to the valve closing duration of the electromagnetic spill valve 54. More specifically, if a cam angle corresponding to the maximum valve closing duration of the electromagnetic spill valve 54 (i.e., the maximum cam angle) is represented by "θ0", and a cam angle corresponding to a target value of the valve closing duration of the electromagnetic spill valve 54 (target cam angle) is represented by "θ", the duty ratio DT indicates the proportion of the target cam angle θ with respect to the maximum cam angle θ0. Therefore, the duty ratio DT is set to a value closer to 100% as the desired valve closing duration (valve closing start timing) of the electromagnetic spill valve 54 becomes closer to the maximum valve closing duration. The duty ratio DT is set to a value closer to 0% as the desired valve closing duration of the electromagnetic spill valve 54 becomes closer to "0".

As the duty ratio DT approaches 100%, the valve closing start timing of the electromagnetic spill valve 54, which is adjusted based on the duty ratio DT, is advanced, and the valve closing duration of the electromagnetic spill valve 54 increases. As a result, the amount of fuel delivered from the high-pressure fuel pump 47 increases, resulting in an increase in the fuel pressure P. As the duty ratio DT approaches 0%, the valve closing start timing of the electromagnetic spill valve 54, which is adjusted based on the duty ratio DT, is retarded, and the valve closing duration of the electromagnetic spill valve 54 is thus reduced. As a result, the amount of fuel delivered from the high-pressure fuel pump 47 decreases, resulting in a reduction in the fuel pressure P.

Figure 4:
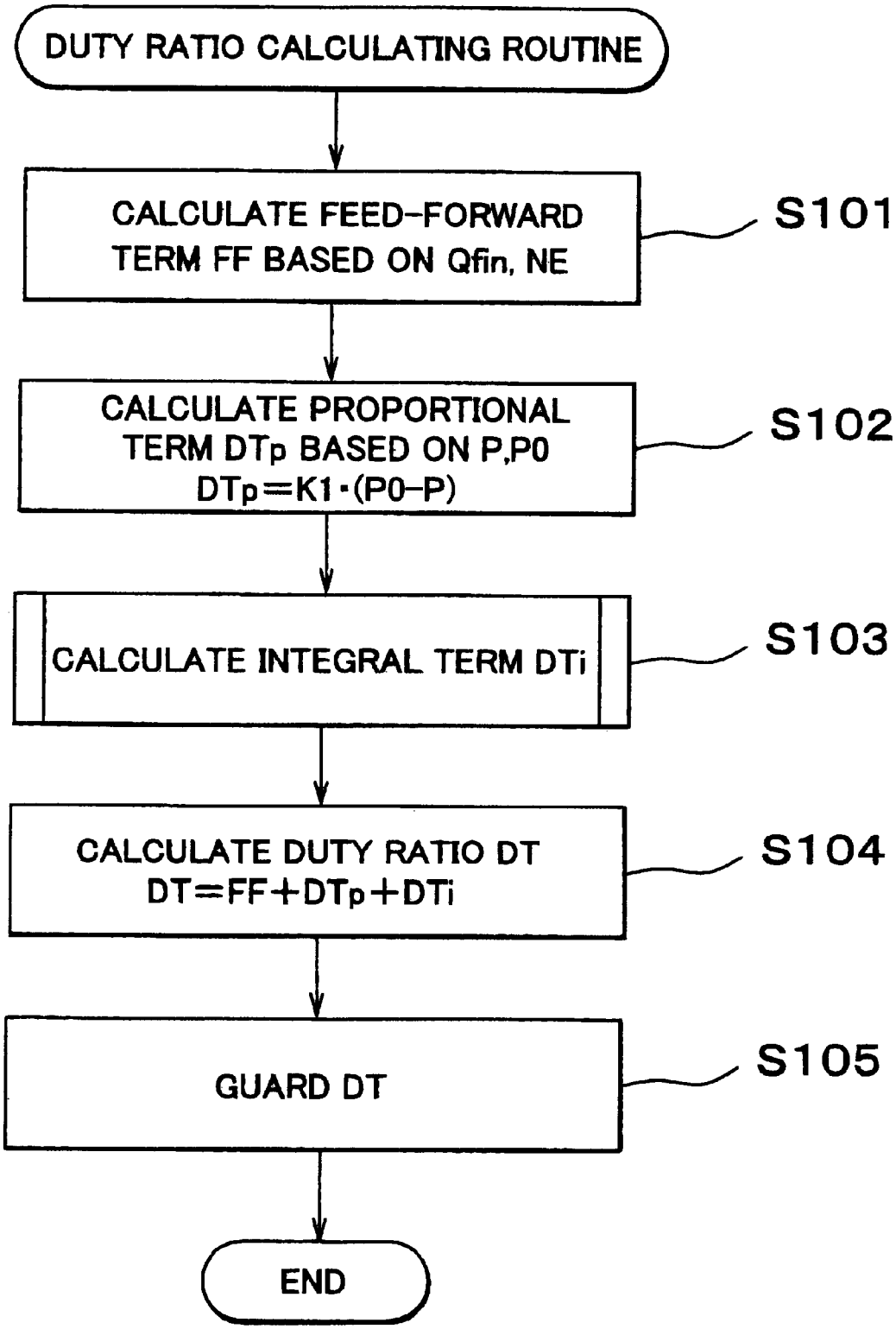
FIG. 4 is a flowchart illustrating a process of calculating a duty ratio DT.

Next, a process of calculating the duty ratio DT will be described with reference to the flowchart of FIG. 4 that illustrates a duty ratio calculating routine. The duty ratio calculating routine, which is an interrupt process, is executed by the ECU 92 at certain time intervals.

In the duty ratio calculating routine, step S104 is first executed to calculate the duty ratio DT according to the following expression (1).

$$DT=FF+DTp+DTi \quad (1)$$

FF: feed-forward term

DTp: proportional term

DTi: integral term

In the above expression (1), the feed-forward term FF is provided for supplying the delivery pipe 53 with an amount of fuel that matches the required amount of fuel injection, and for quickly bringing the fuel pressure P close to the target fuel pressure P0 even during a transitional stage of the engine operation, for example. The feed-forward term FF is calculated in step S101. Furthermore, in the above expression (1), the proportional term DTp is provided for bringing the fuel pressure P closer to the target fuel pressure P0. The integral term DTi is provided for reducing variations in the duty ratio DT due to fuel leakage, differences among individual high-pressure fuel pumps (47), and so on. The proportional term DTp is calculated in step S102. The integral term DTi is calculated in step S103.

Based on the duty ratio DT calculated according to the above expression (1), the ECU 92 controls the point of time at which the electromagnetic solenoid 54*a* of the electromagnetic spill valve 54 starts being energized, namely, the valve closing start timing of the spill valve 54. By controlling the valve closing start timing of the electromagnetic spill valve 54 in this manner, the valve closing duration of the electromagnetic spill valve 54 is changed, and the amount of fuel delivered from the high-pressure fuel pump 47 is thus adjusted, so that the fuel pressure P changes to be close to the target fuel pressure P0.

In the duty ratio calculating routine, the ECU 92 calculates a feed-forward term FF in step S101 based on the operating state of the engine, such as the final amount of fuel injection Qfin and the engine speed NE. The feed-forward term FF increases with an increase in the required amount of fuel injection, so that the duty ratio DT becomes closer to 100%, that is, changes in such a direction as to increase the amount of fuel delivered from the high-pressure fuel pump 47.

Subsequently, the ECU 92 executes step S102 to calculate a proportional term DTp according to the following expression (2) based on the actual fuel pressure P and the target fuel pressure P0 that has been set.

$$DTp=K1\cdot(P0-P) \quad (2)$$

K1: coefficient

P: actual fuel pressure

P0: target fuel pressure

It will be understood from the above expression (2) that, if the actual fuel pressure P is smaller than the target fuel pressure P0, the proportional term DTp increases with an increase in the difference ("P0–P") between the actual and target fuel pressures, so that the duty ratio DT is changed toward 100%, that is, in a direction as to increase the amount of fuel delivered from the high-pressure fuel pump 47. Conversely, if the actual fuel pressure P becomes greater than the target fuel pressure P0, the proportional term DTp decreases with a decrease in the difference ("P0–P") between the actual and target fuel pressures, so that the duty ratio DT is changed toward 0%, that is, in a direction as to decrease the amount of fuel delivered from the high-pressure fuel pump 47.

Subsequently, the ECU 92 executes step S103 to calculate an integral term DTi. The integral term DTi is calculated, for example, according to the following expression (3), based on the integral term DTi obtained in the last control cycle, the actual fuel pressure P and the target fuel pressure P0.

$$DTi=DTi+K2\cdot(P0-P) \quad (3)$$

K2: coefficient

P: actual fuel pressure

P0: target fuel pressure

As is apparent from the expression (3), while the actual fuel pressure P is smaller than the target fuel pressure P0, a value corresponding to the difference ("P0–P") between the actual and target fuel pressures is added to the integral term DTi in every cycle at certain time intervals. As a result, the integral term DTi is gradually updated to greater values, so that the duty ratio DT is gradually changed toward 100% (in such a direction as to increase the amount of fuel delivered from the high-pressure fuel pump 47). Conversely, while the fuel pressure P is greater than the target fuel pressure P0, a value corresponding to the difference ("P0–P") between the actual and target fuel pressures is subtracted from the integral term DTi in every cycle at certain intervals. As a result, the integral term DTi is gradually updated to smaller values, so that the duty ratio DT is gradually changed toward 0% (in such a direction as to decrease the amount of fuel delivered from the high-pressure fuel pump 47).

The ECU 92 then executes step S104 to calculate a duty ratio DT according to the above-indicated expression (1), and performs a guard operation in step S105 so as to prevent the duty ratio DT from falling below 0% or exceeding 100%. After that, the ECU 92 temporarily terminates the duty ratio calculating routine.

Figure 5:
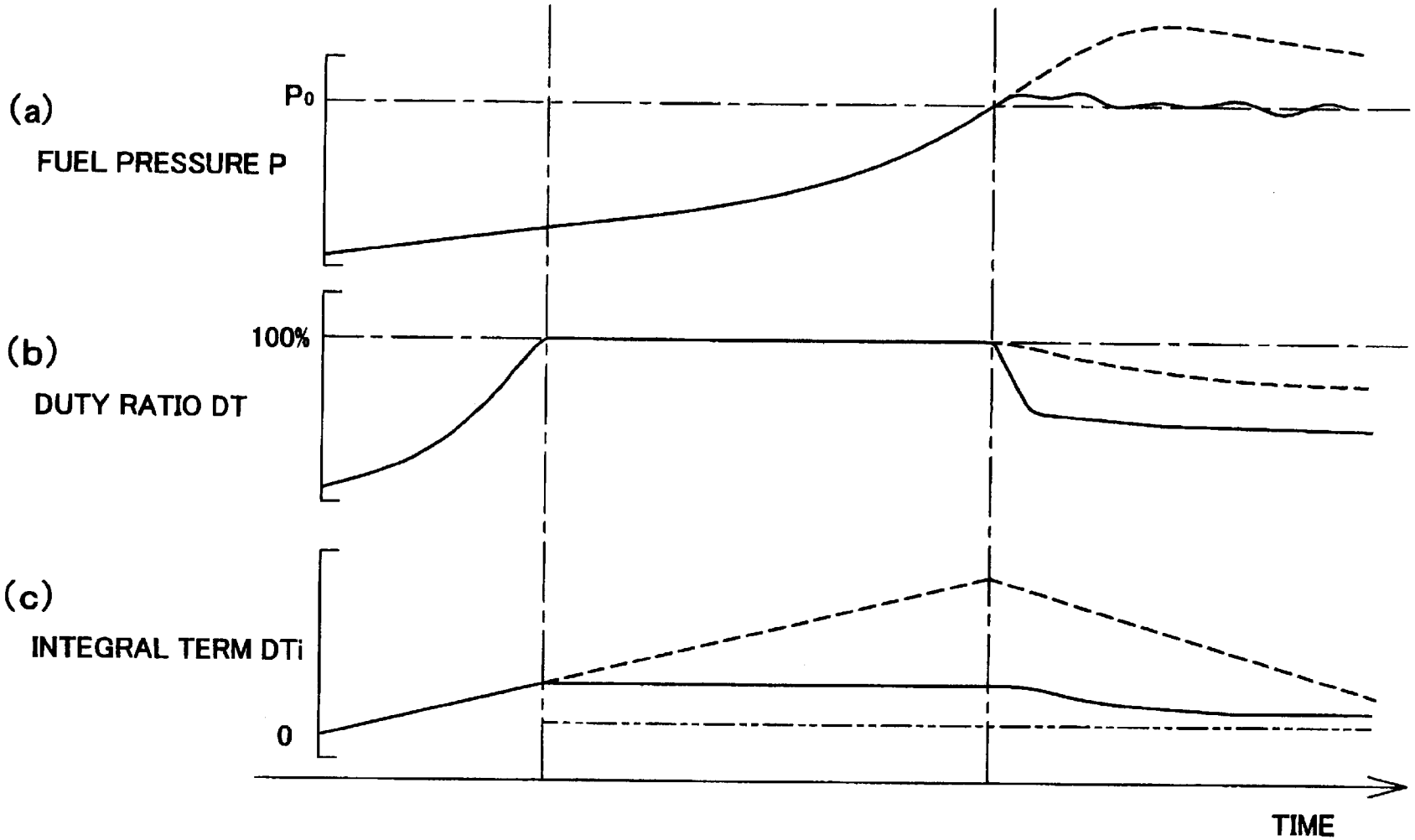
FIG. 5 is a time chart indicating changes of the fuel pressure P, the duty ratio DT, and the integral term DTi, respectively, after the engine is started.

If the fuel pressure P is low, for example, upon the start of the engine, despite a large required amount of fuel injection, the fuel pressure P indicated by a solid line at (a) in FIG. 5 is considerably lower than the target fuel pressure P0 indicated by a one-dot chain line. In this state, the fuel pressure P needs to be quickly increased to the target fuel pressure P0 by setting the amount of fuel delivered from the high-pressure fuel pump 47 to a value close to the maximum value. To this end, the duty ratio DT is increased toward 100% as indicated by a solid line at (b) in FIG. 5. This is because the proportional term DTp calculated based on the difference ("P0–P") between the target fuel pressure P0 and the fuel pressure P becomes a large positive value that increases the duty ratio DT, and because the integral term DTi calculated based on the difference ("P0–P") is updated (i.e., increased) so as to increase the duty ratio DT toward 100%, as indicated by a solid line at (c) in FIG. 5.

During the starting period of the engine in which the fuel pressure P is considerably lower than the target fuel pressure P0, the fuel pressure P continues to be less than the target fuel pressure P0 for a while after the duty ratio DT is increased to 100%. During this time, the proportional term DTp keeps increasing the duty ratio DT. Furthermore, the integral term DTi is gradually updated to greater values by amounts corresponding to the difference ("P0−P") between the target fuel pressure P0 and the fuel pressure P in order to increase the duty ratio DT. Thus, the integral term DTi is gradually increased as indicated by a broken line at (c) in FIG. 5. During this state, the duty ratio DT is guarded so as not to exceed 100%, and is thus kept at 100%.

Thus, since the fuel pressure P remains below the target fuel pressure P0 for a while after the duty ratio DT reaches 100%,. the integral term DTi is kept updated in an increasing direction, to become an excessively large value. When the fuel pressure P exceeds the target fuel pressure P0 while the integral term DTi assumes an excessively large value, the proportional term DTp is quickly changed to a value that changes the duty ratio DT toward the 0% side. In contrast, the integral term DTi exhibits only slow changes to smaller values so as to decrease the duty ratio DT toward the 0% side as indicated by a broken line at (c) in FIG. 5.

Since the integral term DTi decreases at a low rate from an excessively increased value as described above, the duty ratio DT is also changed (i.e., reduced) toward 0% at a low rate after the fuel pressure P reaches the target fuel pressure P0, as indicated by a broken line at (b) in FIG. 5. During this state, the duty ratio DT deviates from a required value in such a direction as to increase the amount of fuel delivered from the high-pressure fuel pump 47 namely, the duty ratio DT is closer to 100% than the required value). Since the duty ratio DT deviates from the required value toward the 100% side, the amount of fuel delivered from the high-pressure fuel pump 47 is also slowly reduced after the fuel pressure P reaches the target fuel pressure P0. Thus, as indicated by a broken line at (a) in FIG. 5, the fuel pressure P becomes excessively larger than the target fuel pressure P0, that is, so-called "overshoot" occurs, resulting in problems such as deterioration of the combustion state of the engine 11.

In this embodiment, therefore, when the duty ratio DT reaches 100% while the actual fuel pressure P has not increased up to the target fuel pressure P0, that is, when the amount of fuel delivered from the high-pressure fuel pump 47 is approximate to or equal to the maximum value, the integral term DTi is prohibited from being changed or updated in such a direction as to increase the amount of fuel delivered (i.e., in a direction as to increase the duty ratio DT). In this case, when the duty ratio DT reaches 100% as indicated by a solid line at (b) in FIG. 5, the upgrading of the integral term DTi in the increasing direction as indicated by the broken line at (c) in FIG. 5 is prohibited, and the integral term DTi is kept at a constant value as indicated by a solid line at (c) in FIG. 5.

Since the integral term DTi is thus prevented from being excessively increased as described above, the duty ratio DT can be promptly reduced toward 0% as indicated by the solid line at (b) in FIG. 5 after the fuel pressure P reaches the target fuel pressure P0. Thus, the duty ratio DT is less likely to deviate from a required value in such a direction as to increase the amount of fuel delivered from the high-pressure fuel pump 47 (i.e., toward 100%). Consequently, after the fuel pressure P reaches the target fuel pressure P0, the amount of fuel delivered from the high-pressure fuel pump 47 can be promptly reduced, thus suppressing "overshoot" as mentioned above. With the "overshoot" thus suppressed or prevented, the fuel pressure P changes as indicated by the solid line at (a) in FIG. 5 after reaching the target fuel pressure P0.

Figure 6:
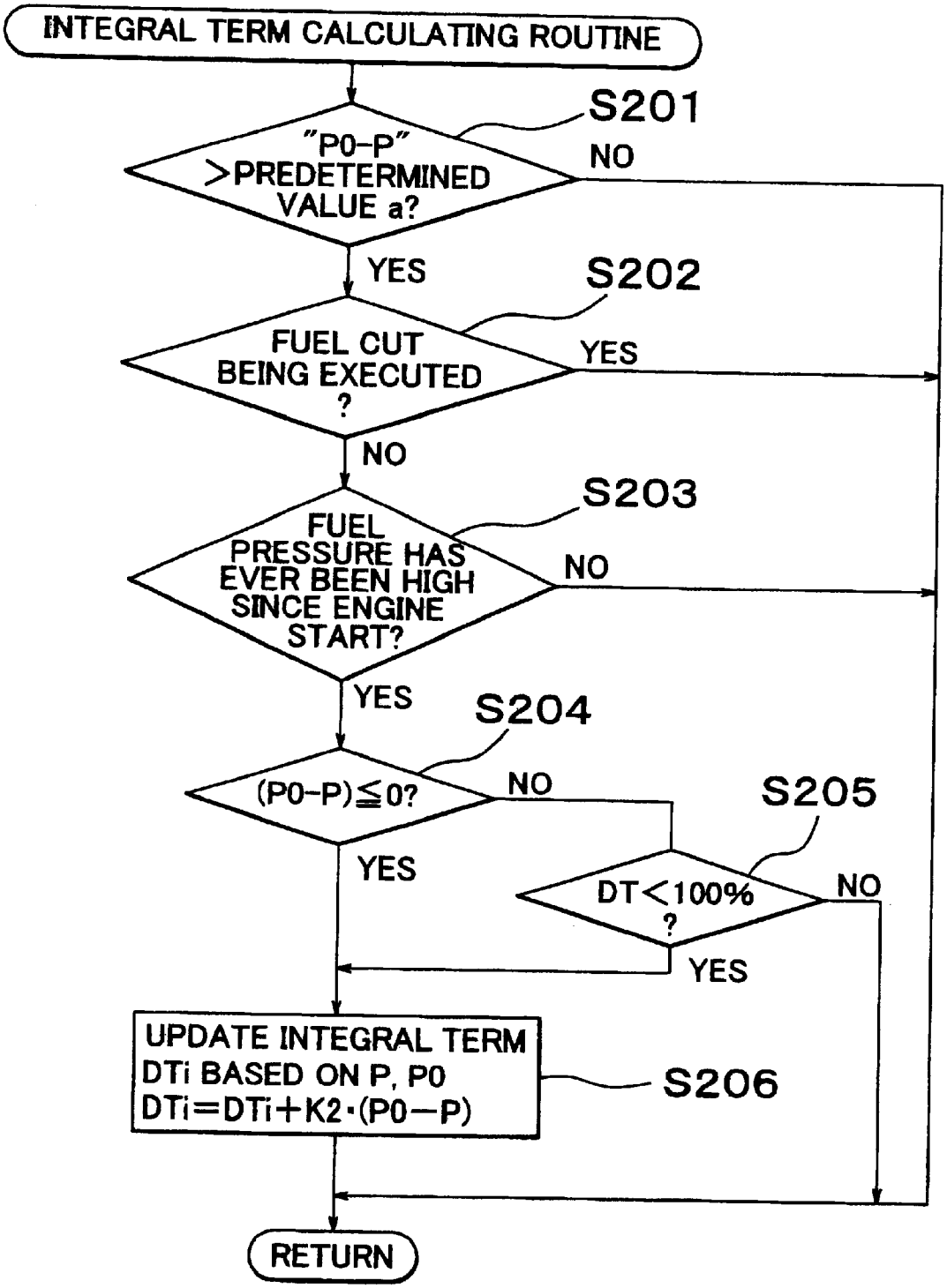
FIG. 6 is a flowchart illustrating a process of calculating an integral term DTi.

Next, a process of prohibiting updating of the integral term DTi in such a direction as to increase the amount of fuel delivered from the high-pressure fuel pump 47 will be described with reference to FIG. 6. The flowchart of FIG. 6 shows an integral term calculating routine, which is executed in step S103 of the duty ratio calculating routine as shown in FIG. 4. The ECU 92 executes the integral term calculating routine each time the control process. Proceeds to step S103 of the duty ratio calculating routine.

In the integral term calculating routine, the integral term DTi is calculated in step S206 according to the above-indicated expression (3). In steps S201 to S205, it is determined whether the duty ratio DT should be updated according to the above expression (3) in the current situation. More specifically, steps S204 and S205 are executed to determine whether the duty ratio DT has reached 100% while the actual fuel pressure P has not reached the target fuel pressure P0, that is, whether the amount of fuel delivered from the high-pressure fuel pump 47 is approximate to or equal to the maximum value.

In the integral term calculating routine, the ECU 92 determines in step S201 whether the difference "P0−P" between the target fuel pressure P0 and the actual fuel pressure P is at least a predetermined value "a" (e.g., −2 MPa). In step S202, the ECU 92 determines whether a fuel cut is being carried out. In the next step S203, the ECU 92 determines whether the fuel pressure P has ever reached a high level (e.g., 4 MPa) after the start of the engine.

If a negative decision (NO) is obtained in step S201 or step S203 or an affirmative decision (YES) is obtained in step S202, the ECU 92 determines that the integral term DTi should not be updated in the current situation, and then temporarily ends the integral term calculating routine. The ECU 92 then returns to the duty ratio calculating routine (FIG. 4). In this case, the updating of the integral term DTi according to the above-indicated expression (3) in step S206 is not executed. Furthermore, in S103 of the duty ratio calculating routine (FIG. 4) following this cycle of the integral term calculating routine, the integral term DTi used in the last cycle of the duty ratio calculating routine is used for calculating the duty ratio DT.

Conversely, if affirmative decisions (YES) are obtained in steps S201 and S203 and a negative decision (NO) is obtained in step S202, the ECU 92 proceeds to step S204. In S204, it is determined whether the difference "P0−P" is equal to or smaller than zero, namely, whether the actual fuel pressure P is greater than the target fuel pressure P0. In step S205, it is determined whether the duty ratio DT has reached 100%.

If step S204 determines that the difference "P0−P" is equal to or smaller than "0", that is, the actual fuel pressure P is greater than the target fuel pressure P0, the ECU 92 then proceeds to step S206, in which the ECU 92 updates the integral term DTi according to the following expression (3). In this case, the integral term DTi is updated in such a direction as to decrease the duty ratio DT. After that, the ECU 92 temporarily ends the integral term calculating routine, and returns to the duty ratio calculating routine (FIG. 4). If the ECU 92 determines in step S204 that the difference "P0−P" is greater than "0", that is, the actual fuel pressure P is smaller than the target fuel pressure P0, the ECU 92 proceeds to step S205. For example, the control process proceeds to step S205 while the actual fuel pressure P is in the course of increasing toward the target fuel pressure P0.

In step S205, the ECU 92 determines whether the duty ratio DT is less than 100%. If it is determined that the duty ratio DT is less than 100%, that is, if it is determined that the amount of fuel delivered from the high-pressure fuel pump 47 is not approximate to or equal to the maximum value, the ECU 92 proceeds to step S206, in which the ECU 92 updates the integral term DTi according to the expression (3). After that, the ECU 92 temporarily ends the integral term calculating routine, and returns to the duty ratio calculating routine (FIG. 4). If step S205 determines that the duty ratio DT has reached 100%, that is, if it determines that the amount of fuel discharged from the high-pressure fuel pump 47 is approximate to or equal to the maximum value, the ECU 92 then temporarily ends the integral term calculating routine, and returns to the duty ratio calculating routine (FIG. 4). In this case, step S206 is skipped, namely, the updating of the integral term DTi according to the expression (3) in steep S206 is not executed.

The embodiment, in which the above-described process is executed, yields the following effects or advantages.

Upon the start of the engine, for example, it takes some time for the actual fuel pressure P to be raised to the target fuel pressure P0. During the time in which the fuel pressure P increases up to the target fuel pressure P0, the integral term DTi would be gradually updated to larger values. In the illustrated embodiment, however, the updating of the integral term DTi is prohibited when the amount of fuel delivered from the high-pressure fuel pump 47 becomes approximate to or equal to the maximum value ("DT=100%") while the actual fuel pressure P is less than the target fuel pressure P0 ("(P0−P)>0"). This prevents the integral term DTi from being kept updated to larger values even after the duty ratio DT reaches 100% until the term DTi becomes an excessively large value. Thus, the embodiment substantially prevents or suppress overshoot that would otherwise occur due to the excessively large integral term DTi after the actual fuel pressure P reaches the target fuel pressure P0, and therefore avoids problems such as deterioration of the combustion state due to the overshoot.

The embodiment may be modified, for example, in the following manners.

For example, when the updating of the integral term DTi is prohibited after a negative decision (NO) is obtained in step S205 of the integral term calculating routine (FIG. 6) as in the illustrated embodiment, the integral term DTi may also be forced to be updated to a smaller value (e.g., reset to "0"), and the updating of the integral term DTi may be prohibited only when the term DTi is to be increased. In this case, when the duty ratio DT reaches 100% as indicated by the solid line at (b) in FIG. 5 while the fuel pressure P has not increased to the target fuel pressure P0 as indicated by the solid line at (a) in FIG. 5, the integral term DTi is set to "0" as indicated by a two-dot chain line at (c) in FIG. 5. This makes it possible to further reliably prevent the integral term DTi from being increased to an excessively large value.

Although step S205 of the integral term calculating routine of FIG. 6 determines whether the amount of fuel delivered from the high-pressure fuel pump 47 is approximate to or equal to the maximum value based on the result of determination as to whether the duty ratio DT is less than 100%, the invention is not limited to this process. For example, the above determination may be made by using a sum "FF+DTp" of the feed-forward term FF and the proportional term DTp, instead of using the duty ratio DT. In this case, it is determined whether the amount of fuel delivered from the high-pressure fuel pump 47 is approximate to or equal to the maximum value, based on the result of determination as to whether the sum "FF+DTp" is less than 100%.

While the invention has been described with reference to what is presently considered to be a preferred embodiment thereof, it is to be understood that the invention is not limited to the disclosed embodiment or constructions. To the contrary, the invention is intended to cover various modifications and equivalent arrangements.

What is claimed is:

1. A fuel pressure control apparatus for controlling a pressure of a fuel that is delivered from a fuel pump to a fuel pipe in an internal combustion engine of a vehicle, comprising:

a controller that:

calculates a controlled variable based on at least an integral term that is updated in accordance with a difference between an actual fuel pressure in the fuel pipe and a target value thereof;

controls an amount of the fuel delivered from the fuel pump in a feedback manner, using the controlled variable, so that the actual fuel pressure approaches the target value; and inhibits updating of the integral term to a value that results in an increase in the amount of the fuel delivered from the fuel pump, when the amount of the fuel delivered is approximate to or equal to a maximum value thereof.

2. The fuel pressure control apparatus according to claim 1, wherein the controller resets the integral term to a value that results in a decrease in the amount of the fuel delivered from the fuel pump, when the updating of the integral term starts being inhibited.

3. The fuel pressure control apparatus according to claim 1, wherein the controller inhibits updating of the integral term to a value that results in an increase in the amount of the fuel delivered from the fuel pump, at least when the amount of the fuel delivered becomes approximate to or equal to the maximum value while the actual fuel pressure is increasing toward the target value.

4. The fuel pressure control apparatus according to claim 3, wherein the controller resets the integral term to a value that results in a decrease in the amount of the fuel delivered from the fuel pump, when the updating of the integral term starts being inhibited.

5. The fuel pressure control apparatus according to claim 1, wherein the controller determines whether the amount of the fuel delivered from the fuel pump is approximate to or equal to the maximum value, based on the controlled variable.

6. The fuel pressure control apparatus according to claim 1, wherein the controlled variable is calculated based on a feed-forward term that is obtained in accordance with an engine operating state, and a proportional term that is obtained in accordance with the difference between the actual fuel pressure in the fuel pipe and the target value, in addition to the integral term.

7. The fuel pressure control apparatus according to claim 1, wherein the controller determines whether the amount of the fuel delivered from the fuel pump is approximate to or equal to the maximum value, based on a sum of a feed-forward term that is obtained in accordance with an engine operating state, and a proportional term that is obtained in accordance with the difference between the actual fuel pressure in the fuel pipe and the target value.

8. A method of controlling a pressure of a fuel that is delivered from a fuel pump to a fuel pipe in an internal combustion engine of a vehicle, comprising the steps of:

calculating a controlled variable based on at least an integral term that is updated in accordance with a difference between an actual fuel pressure in the fuel pipe and a target value thereof;

controlling an amount of the fuel delivered from the fuel pump in a feedback manner, using the controlled variable, so that the actual fuel pressure approaches the target value; and inhibiting updating of the integral term to a value that results in an increase in the amount of the fuel delivered from the fuel pump, when the amount of the fuel delivered is approximate to or equal to a maximum value thereof.

9. The method according to claim 8, further comprising the step of:

resetting the integral term to a value that results in a decrease in the amount of the fuel delivered from the fuel pump, when the updating of the integral term starts being inhibited.

10. The method according to claim 8, wherein the integral term is inhibited from being updated to a value that results in an increase in the amount of the fuel delivered from the fuel pump at least when the, amount of the fuel delivered becomes approximate to or equal to the maximum value while the actual fuel pressure is increasing toward the target value.

11. The method according to claim 10, further comprising the step of:

resetting the integral term to a value that results in a decrease in the amount of the fuel delivered from the fuel pump, when the updating of the integral term starts being inhibited.

12. The method according to claim 8. wherein it is determined whether the amount of the fuel delivered from the fuel pump is approximate to or equal to the maximum value, based on the controlled variable.

13. The method according to claim 8, wherein the controlled variable is calculated based on a feed-forward term that is obtained in accordance with an engine operating state, and a proportional term that is obtained in accordance with the difference between the actual fuel pressure in the fuel pipe and the target value, in addition to the integral term.

14. The method according to claim 8, wherein it is determined whether the amount of the fuel delivered from the fuel pump is approximate to or equal to the maximum value, based on a sum of a feed-forward term that is obtained in accordance with an engine operating state, and a proportional term that is obtained in accordance with the difference between the actual fuel pressure in the fuel pipe and the target value.

* * * * *